US007280339B2

(12) United States Patent
Manzone et al.

(10) Patent No.: US 7,280,339 B2
(45) **Date of Patent: *Oct. 9, 2007**

(54) OPERATING DEVICE FOR INDUCTIVE ELECTRICAL ACTUATORS

(75) Inventors: Alberto Manzone, Alba (IT); Paolo Santero, Orbassano (IT); Riccardo Groppo, Roletto (IT)

(73) Assignee: C.R.F. Societa Consortile per Azioni (IT)

( * ) Notice: Subject to any disclaimer, the term of this patent is extended or adjusted under 35 U.S.C. 154(b) by 445 days.

This patent is subject to a terminal disclaimer.

(21) Appl. No.: 10/989,726

(22) Filed: Nov. 17, 2004

(65) Prior Publication Data

US 2005/0141167 A1 Jun. 30, 2005

(30) Foreign Application Priority Data

Nov. 25, 2003 (IT) ..... TO2003A0939

(51) Int. Cl.
*H01H 47/00* (2006.01)

(52) U.S. Cl. ..... 361/139; 123/490

(58) Field of Classification Search ..... 361/139; 123/300, 480

See application file for complete search history.

(56) References Cited

U.S. PATENT DOCUMENTS 3,456,628 A * 7/1969 Bassot et al. ..... 123/490
4,327,693 A * 5/1982 Busser ..... 123/490
5,775,296 A * 7/1998 Goras et al. ..... 123/406.47
6,173,700 B1 * 1/2001 Yamashita et al. ..... 123/490
6,360,725 B1 * 3/2002 Scherrbacher ..... 123/490
6,539,925 B2 * 4/2003 Rueger et al. ..... 123/490
6,684,862 B2 * 2/2004 Oyama et al. ..... 123/490
7,059,304 B2 * 6/2006 Manzone et al. ..... 123/490
2005/0126542 A1 * 6/2005 Oono ..... 123/479

* cited by examiner

*Primary Examiner*—Michael Sherry
*Assistant Examiner*—Christopher J Clark
(74) *Attorney, Agent, or Firm*—Berenato, White & Stavish

(57) ABSTRACT

A power circuit provided with an operating circuit for each electrical actuator and including a set of switches controlled selectively to regulate the current flowing through the electrical actuator. The operating device includes a control circuit which can cause the operation of the power circuit and in turn includes a set of control modules, each of which can selectively operate the switches of a corresponding operating circuit, and can supply a state signal ($S_{FLAG}$) indicating the operating state of the control module. A synchronization module receives and processes the state signals ($S_{FLAG}$), to generate a common synchronization signal ($S_{SINC}$) which synchronizes the control modules. Each control module being capable of coordinating the operating actions sent to the switches of the corresponding operating circuit with the operating actions sent by the other control modules to the corresponding switches, in accordance with the synchronization signal ($S_{SINC}$).

14 Claims, 4 Drawing Sheets

OPERATING DEVICE FOR INDUCTIVE ELECTRICAL ACTUATORS

The present invention relates to an operating device for inductive electrical actuators.

In particular, the present invention can be applied advantageously but not exclusively to the operating of electrical injectors or a fuel injection system of an internal combustion engine of a motor vehicle, particularly those of a common rail fuel injection system of a diesel engine, to which the following description will refer expressly without thereby losing any of its generality.

This does not imply that the operating device according to the invention cannot be applied to other types of engine, such as petrol, methane or LPG engines, or to any other type of inductive electrical actuator such as solenoid valves of ABS devices and the like, solenoid valves of variable timing systems, etc.

As is known, the electrical injectors of a common rail fuel injection system are usually controlled by supplying to each electrical injector a current whose variation in time comprises a stage of rapid increase to a first set value, a first stage in which the amplitude oscillates about the first set value, a first stage of decrease to a second set value, a second stage in which the amplitude oscillates about the second set value, and a second stage of rapid decrease to a value of approximately zero.

As is known, an electrical injector comprises an outer body forming a cavity communicating with the outside by means of an injection nozzle, in which is housed an axially movable plug for opening and closing the nozzle, in response to the opposing axial forces provided by the pressure of the injected fuel, on the one hand, and by a spring and a rod, on the other hand, this rod being positioned along the axis of the needle on the opposite end to the nozzle and being operated by an electromagnetic dosing valve.

In the initial stage of the opening of the electrical injector, it is necessary not only to exert a considerable force against the action of the spring, but also to move the rod from the rest position to the operating position as rapidly as possible. For this reason, the energizing current of the electromagnet in the first phase is rather high (the first set value). The rapid rise of the current to the first set value is necessary to make the instant of the start of actuation sufficiently precise in time. Once the rod has reached the end position, however, the electrical injector remains open even with lower currents, which is why the variation of the electromagnet energizing current shows the stages of decrease and maintenance around the second set value.

To achieve this variation of the energizing current, use was formerly made of a operating device in which the electrical injectors were connected, on one hand, directly to a power supply line., and, on the other hand, to a ground line through a controlled electronic switch.

However, this operating device had the drawback that any short circuit to ground of one of the terminals of any one of the electrical injectors, due for example to a loss of insulation in a conductor of the wiring of the said electrical injectors and the contact of this conductor with the bodywork of the motor vehicle, would cause irremediable damage to the said electrical injector and/or to the operating device, thus causing the vehicle to stop, which would be a highly dangerous situation if it occurred during travel.

To overcome this dangerous drawback, European Patent EP 0 924 589 in the name of the present applicant proposed an operating device in which the electrical injectors were floating with respect to the supply lines, in other words were connected to the supply line and to the ground line through corresponding controlled electronic switches. Thus, any short circuit to ground or to the power supply of one of the terminals of the electrical injectors would not cause any damage to the operating device with the consequent stopping of the motor vehicle, but would simply cause the single electrical injector in question to go out of use, enabling the vehicle to continue running in the absence of one electrical injector.

In the operating device described in the patent cited above, the high voltage required to cause the rapid rise in current in the initial stage of opening of the electrical injector is generated by means of a booster circuit which raises the voltage supplied by the battery of the motor vehicle, and which essentially consists of a DC/DC converter.

It is also known that one approach to the problem of improving the performance and reducing the emissions of engines, particularly diesel engines with common rail fuel injection systems, consists in the raising of the injection pressure of the fuel, for example up to values of 1800 bars.

The most immediate result of this pressure increase is an increase in the force exerted by the spring to balance the fuel pressure and, keep the electrical injector closed; consequently, a greater force must be exerted on the rod of an electrical injector to overcome the action of the spring. To enable the force exerted by the electromagnet to be increased without the need to change the current levels, the number of turns, and therefore the inductance, of the electromagnet is increased.

This results in an increase in the energy $$E = \frac{1}{2} \cdot L \cdot I^2$$

(and therefore of the power) to be supplied by the booster circuit during the initial stage of driving the electrical injector, in which the current rises rapidly.

However, since the DC/DC converter is designed to match the power to be supplied to the electrical injector, and particularly since the dimensions of the DC/DC converter increase with a rise in the power to be obtained at the output of the said DC/DC converter, the raising of the fuel injection pressure would require the use of a DC/DC converter having considerably larger dimensions than that used at present, with a consequent increase in the area occupied by the DC/DC converter, the overall dimensions of the operating device, and the corresponding costs.

To overcome the problem of the overall dimensions of the operating device, a booster circuit consisting of a single capacitor has recently been developed, this circuit being capable of recharging this capacitor by means of one or more of the electrical injectors which are not operational, in other words not involved in an injection of fuel.

In particular, in the instant in which the capacitor of the voltage booster circuit is to be recharged, an electrical injector which at that instant is not involved in an injection of fuel is identified in the first place, electrical energy is then accumulated in this electrical injector, and finally the electrical energy accumulated by the electrical injector is transferred to the capacitor of the voltage booster circuit.

The accumulation of electrical energy in one of the electrical injectors not involved in an injection of fuel and the transfer of this accumulated energy to the capacitor of the voltage booster circuit are carried out by means of the power circuit described in the applicant's previously cited European patent.

As shown in FIG. 1, the aforementioned operating device comprises a power circuit, indicated as a whole by 10, comprising in turn a plurality of operating circuits 11, one for each electrical injector 12; and a control circuit for operating the operating circuits.

For simplicity of illustration, FIG. 1 shows four operating circuits 11 for four electrical injectors 12 belonging to the same cylinder bank of the engine (not shown), each of which is shown in the figure with its corresponding equivalent circuit formed by a resistor and an inductor connected in series. Each operating circuit 11 comprises a first and a second input terminal 13, 14, connected to the positive pole and to the negative pole of the battery 23 of the motor vehicle, which supplies a voltage $V_{BATT}$ whose nominal value is typically 12 V; a third and a fourth input terminal 15, 16, connected to a first and a second output terminal of a booster circuit 8 common to all the operating circuits, to which it supplies a boosted voltage $V_{BOOST}$ which is greater than the battery voltage $V_{BATT}$, for example 50 V; and a first and a second output terminal 19, 20, between which the corresponding electrical injector 12 is connected.

The terminal of each electrical injector 12 connected to the first output terminal 19 of the corresponding operating circuit 11 is typically called the "high side" terminal, while the terminal of each electrical injector 12 connected to the second output terminal 20 of the corresponding operating circuit 11 is typically called the "low side" terminal.

In its simplest embodiment, the booster circuit 8 is formed by a single capacitor 21, called the "boost capacitor", connected between the first and the second output terminal of the booster circuit 8, a comparator stage with hysteresis 22 being connected across the terminals of this capacitor and supplying at its output a logic signal having a first logic level, high for example, when the voltage across the terminals of the capacitor 21 is greater than a predetermined upper value, for example 50 V, and a second logic level, low in this example, when the voltage across the terminals of the capacitor 21 is lower than a predetermined lower value, for example 49 V.

Each operating circuit 11 also comprises a ground line 24 connected to the second input terminal 14 and to the fourth input terminal 16, and a power supply line 25 connected on one hand to the first input terminal 13 through a first diode 26, whose anode is connected to the first input terminal 13 and whose cathode is connected to the supply line 25, and on the other hand to the third input terminal 15 through a first MOS transistor 27, having a gate terminal connected to the control circuit (not shown) from which it receives a first control signal, a drain terminal connected to the third input terminal 15, and the source terminal connected to the supply line 25.

Each operating circuit 11 also comprises a second MOS transistor 28 having a gate terminal receiving a second control signal from the control circuit (not shown), a drain terminal connected to the supply line 25, and a source terminal connected to the first output terminal 19; and a third MOS transistor 29 having a gate terminal receiving a third control signal from the control circuit (not shown), a drain terminal connected to the second output terminal 20, and a source terminal connected to the ground line 24 through a sense stage formed by a sense resistor 31 across which is connected an operational amplifier 32 generating at its output a voltage $V_s$ proportional to the current flowing in the said sense resistor 31.

Each operating circuit 11 also comprises a second diode 33, called a "free-wheeling" diode, having its anode connected to the ground line 24 and its cathode connected to the first output terminal 19; and a third diode 34, called the "boost" diode, having its anode connected to the second output terminal 20 and its cathode connected to the third input terminal 15.

The operation of each operating circuit 11 can be divided into three distinct principal stages, characterized by a different variation of the current flowing in the electrical injector 12: a first stage, called the fast charging or "boost" stage, in which the current increases rapidly to a set value at which the electrical injector 12 is opened; a second stage, called the maintenance stage, in which the current oscillates in a sawtooth pattern about the value reached in the preceding stage; and a third stage, called the fast discharge stage, in which the current decrease rapidly from the value taken in the preceding stage to a final value, which can possibly be zero.

In particular, in the fast charging stage the control circuit 8 (not shown) sends the control signals to cause the closing of the transistors 27, 28 and 29, and consequently the boosted voltage $V_{BOOST}$ is applied to the terminals of the electrical injector 12. Thus the current flows in the circuit comprising the capacitor 21, the transistor 27, the transistor 28, the electrical injector 12, the transistor 29 and the sense resistor 31, rising over time in a substantially linear way with a slope of $V_{BOOST}/L$ (where L represents the equivalent series inductance of the electrical injector 12). Since $V_{BOOST}$ is much greater than $V_{BATT}$, the rise in current is much faster than that obtainable with $V_{BATT}$.

In the maintenance stage, the transistor 29 is closed, the transistor 27 is open and the transistor 28 is repeatedly closed and opened, and therefore the terminals of the electrical injector 12 are alternately supplied with the battery voltage $V_{BATT}$ (when the transistor 28 is closed) and a zero voltage (when the transistor 28 is open). In the first case (with the transistor 28 closed) the current flows in the circuit comprising the battery 23, the diode 26, the transistor 28, the electrical injector 12, the transistor 29, and the sense resistor 31, rising exponentially over time, while in the second case (with the transistor 28 open), the current flows in the circuit comprising the electrical injector 12, the transistor 29, the sense resistor 31 and the free-wheeling diode 33, decreasing exponentially over time.

Finally, in the fast discharge stage, the control circuit 8 (not shown) sends the control signals to open the transistors 27, 28 and 29, and consequently the boosted voltage $-V_{BOOST}$ is applied to the terminals of the electrical injector 12 until current flows through the electrical injector 12. Thus the current flows in the circuit comprising the capacitor 21, the booster diode 34, the electrical injector 12 and the free-wheeling diode 33, decreasing over time in a substantially linear way with a slope of $-V_{BOOST}/L$. Since $V_{BOOST}$ is much greater than $V_{BATT}$, the decrease in current is much faster than that obtainable with $V_{BATT}$. In this stage, the electrical energy stored in the electrical injector 12

$$\left(\text{equal to } E = \frac{1}{2} \cdot L \cdot I^2\right)$$

is transferred to the capacitor 21, in such a way as to permit the recovery of some of the energy supplied by the operating circuit 11 during the fast charging stage, thus increasing the efficiency of the system. Calculations which have been carried out show that the percentage of energy recovery associated with this stage can reach a maximum of approximately 25% (depending on the type of electrical injector, the materials used, and the mechanical work done by the electromagnet to move the rod).

Although widely used, the operating device described above has the drawback of not providing correct synchronization of the control signals supplied to each operating circuit by the control circuit during each of the three different stages of current maintenance and control.

The object of the present invention is to provide an operating device for inductive electrical actuators, which provides synchronization of the control signals supplied to each operating circuit during each of the three different stages of current maintenance and control.

What is provided according to the present invention is an operating device for inductive electrical actuators, comprising a power circuit provided with an operating circuit for each electrical actuator; the said operating circuit comprising switch means controlled selectively to regulate the current flowing through the said electrical actuator; the said operating device additionally comprising a control circuit for operating the said power circuit, and being characterized in that it comprises:

a set of control modules, each of which can selectively operate the said switch means of a corresponding operating circuit, and supplies a state signal indicating the operating state of the said control module; and synchronization means for receiving and processing the state signals, to generate a common synchronization signal which can synchronize the said control modules with each other;

each said control module being capable of synchronizing and coordinating, in accordance with the said synchronization signal, the operating actions sent to the corresponding switch means with the operating actions sent by the other control modules to the corresponding switch means.

The present invention will now be described with reference to the attached drawings, which show a non-restrictive example of embodiment of the invention, and in which.

Figure 2:
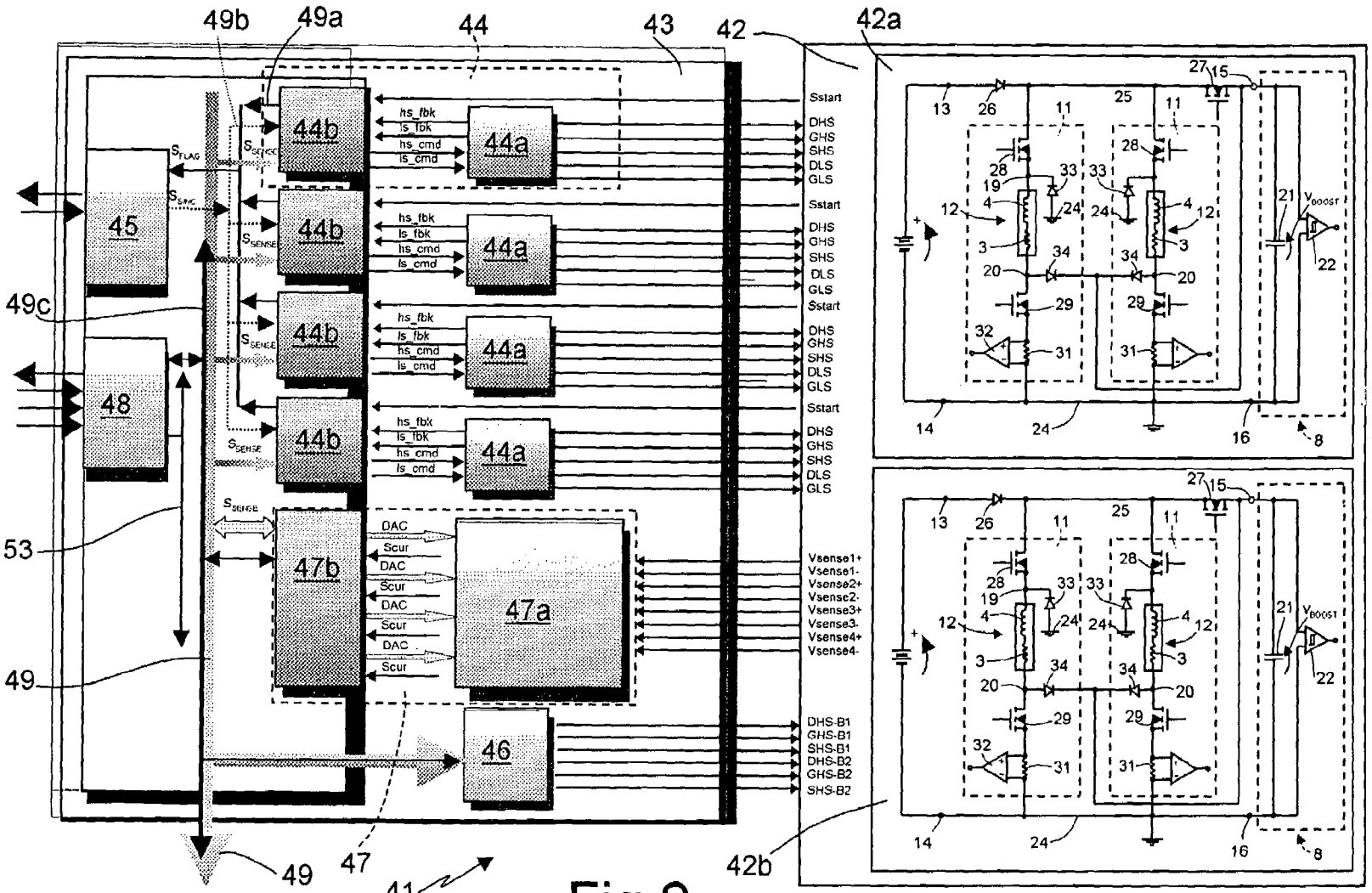
FIG. 2 shows a block diagram of an operating device for inductive electrical actuators, constructed according to the principles of the present invention.

With reference to FIG. 2, the number 41 indicates the whole of an operating device for inductive electrical actuators.

In particular, as mentioned above, the present invention is advantageously, but not exclusively, applicable to the operating of electrical injectors of a fuel injection system of an internal combustion engine of a motor vehicle, in particular to the operating of a common rail fuel injection system of a diesel engine, to which the following description will refer expressly without thereby losing any of its generality.

The operating device 41 essentially comprises a power circuit 42 for supplying the current to the electrical injectors, and a control circuit 43 for operating the power circuit 42 to regulate the current supplied to each electrical injector, in such a way that, on the one hand, the current varies in a predetermined way over time, and, on the other hand, the energy accumulated by an electrical injector is transferred to the capacitor of the voltage booster circuit (as described in detail above).

Figure 1:
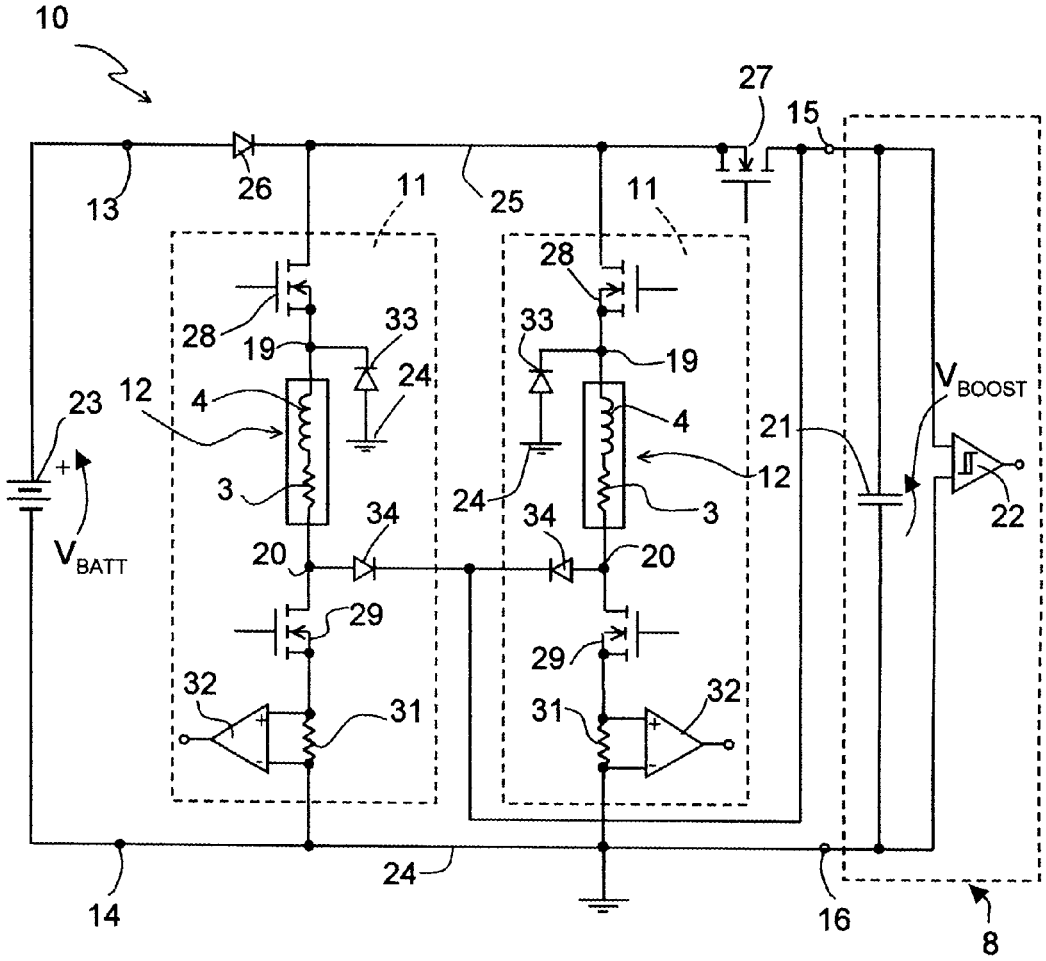
Fig. 1 PRIOR ART
FIG. 1 shows the circuit diagram of a power circuit of an operating device for inductive electrical actuators, constructed according to the prior art.

The power circuit 42 shown schematically in the example of FIG. 2 can control the current in four electrical injectors 12 and comprises two power units 42*a* and 42*b*, each of which consists of a circuit entirely similar to the power circuit 10 for controlling the two electrical injectors shown in FIG. 1, and consequently the elements in common with the power circuit 10 (of FIG. 1) have been assigned the same reference numbers, and will therefore not be described further.

As regards the control circuit 43, this preferably takes the form of an integrated circuit card of the type known as ASIC (acronym for Application Specific Integrated Circuit), whose architecture or circuit structure is shown schematically in FIG. 2, which shows an example of a control circuit for operating the four operating circuits 11 of the power circuit 42, to which the following description will refer expressly without thereby losing any of its generality.

The control circuit 43 essentially comprises: four control units 44 (only one of which is indicated by a broken line), one for each electrical injector (in other words, one for each operating circuit 11), a synchronization unit 45, a booster operating unit 46, a current measurement unit 47, and a communication unit 48 which can "interface" the control card or circuit 43 with one or more external control devices, particularly a main external microcontroller (not shown).

The various aforementioned electrical units 43, 44, 45, 46, 47 and 48 which make up the control circuit 43 are interconnected by a control bus 49, which is used both for the exchange of the control signals between the said units and the exchange of the control signals between the units and the external control devices.

In particular, the main control bus 49 consists of four state buses 49*a* (shown in solid lines), each of which connects a corresponding control unit 44 to the synchronization unit 45; a synchronization bus 49*b* (shown in broken lines) which provides the connection between the synchronization unit 45 and all the control units 44; and a communication bus 49*c*, which is used for exchanging the control signals between the aforementioned units and the external control devices.

With reference to FIG. 2, the measurement unit 47 has the function of detecting, for each electrical injector 12, the voltage $V_S$ supplied by the corresponding sense stage of the operating circuit 11, converting the analogue signal relating to the voltage $V_S$ to the digital signal $S_{SENSE}$ indicating the current flowing in the corresponding sense resistor 31, and, finally, supplying the latter signal to the corresponding control unit 44; while the communication unit 48 controls the communication of information, data and signals between the various units contained in the control circuit 43 and the external control devices, particularly a main external microcontroller (not shown).

In fact, the communication unit 48 consists of a 16-bit communications interface (SPI interface), comprising a first control module (not shown) for controlling the communication requests for both the read and the write operations executed by the main external microcontroller or by the internal units; and a second control module (not shown) having the function of implementing a communication protocol for controlling the addressing of the data in the various stores and/or registers in the various units of the control circuit 43, in the read/write operations.

As regards the booster operating unit 46, this has the function of controlling the first MOS transistor 27 of the operating device 41 in such a way as to control the activation of the booster device. In fact, in the example shown in FIG. 2, the booster operating device 46 can control a pair of booster devices, each connected to two operating circuits 11.

With reference to FIG. 2, each control unit 44 can operate a corresponding operating circuit. 11 of an electrical injector 12, and checks, instant by instant, the operating state of the said operating circuit 11.

In detail, each control unit 44 can receive at its input a signal $S_{SENSE}$ indicating the value of the current flowing in the sense resistor 31 of the corresponding operating circuit 11; a feedback signal hs_fbk containing a set of data relating to the operation of the second MOS transistor 28 (the controlled switch 28 present on the "high side" of the operating circuit 11); and a feedback signal ls_fbk containing a set of data relating to the third MOS transistor 29 (the controlled switch 28 present on the "low side" of the operating circuit 11).

Each control unit 44 can supply at its output a control signal hs_cmd to the second MOS transistor 28, a control signal ls_cmd to the third MOS transistor 29, and a state signal $S_{FLAG}$, which contains a set of data relating to the operating state of the said control unit 44, and can be transmitted via the corresponding state bus 49*a* to the synchronization unit 45. In fact, the control unit 44 encodes a plurality of control flags stored in a number of internal registers (not shown) in the state signal $S_{FLAG}$.

Each control unit 44 consists essentially of a pair of control stages, of which a first control stage, indicated below by the number 44*a*, is formed by an analogue circuit connected directly to a corresponding operating circuit 11, while the second control stage, indicated below by the number 44*b*, is connected on one hand to the communication bus 49 and on the other hand to the first control stage 44*a*, to which it supplies the control signal hs_cmd for the second MOS transistor 28, and the control signal ls_cmd for the third MOS transistor 29.

In greater detail, the first control stage 44*a* is provided with a set of pins or outputs, connected to the terminals of the second and third MOS transistors 28 and 29, to supply these transistors with bias voltages generated in accordance with the control signals hs_cmd and ls_cmd, and is provided, with a circuit for monitoring the "high side" and a circuit for monitoring the "low side" (not shown), which can supply to the input of the second control stage 44*b* the corresponding feedback signals hs_fbk and ls_fbk encoding the information relating to the operation of the second and third MOS transistors 28 and 29.

The second control stage 44*b*, on the other hand, can receive at its input the feedback signals hs_fbk and ls_fbk from the first control stage 44*a*, and the synchronization signal $S_{SINC}$, and supplies at its output the state signal $S_{FLAG}$, and the control signals hs_cmd and ls_cmd.

Figure 3:
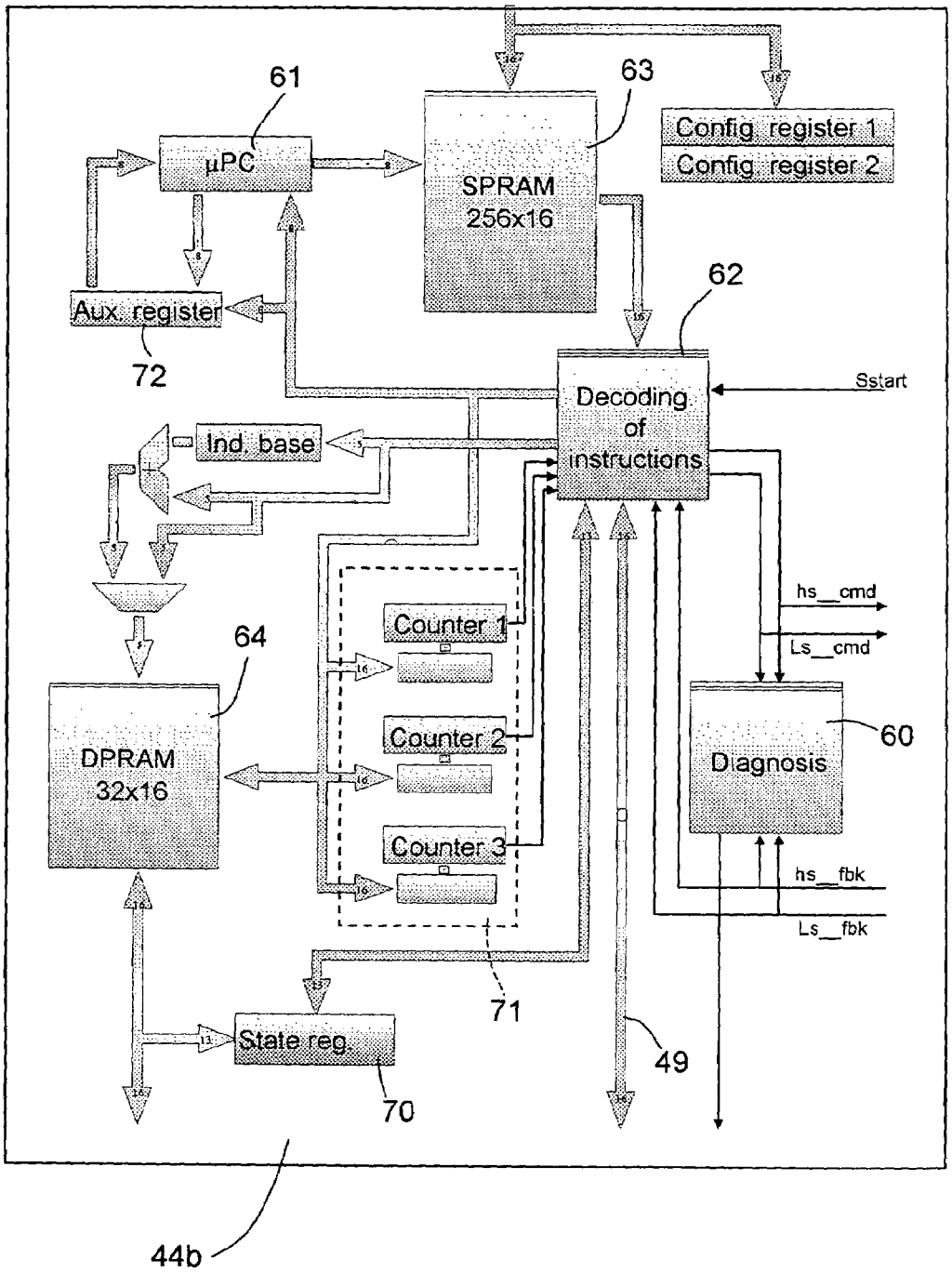
FIG. 3 shows in a schematic way the circuit architecture of a control unit of the operating device shown in FIG. 2.

FIG. 3 shows an example of the circuit architecture of the second control stage 44*b*, which essentially comprises a diagnostic unit 60, a first counting unit 61, an internal microcontroller 62, a main store 63, and a second store 64 in which are stored a plurality of parameters which characterize the operation of the electrical injector 12.

The diagnostic unit 60 can make a comparison, instant by instant, between the control signals hs_cmd and ls_cmd supplied at the output, and the feedback signals hs_fbk and ls_fbk received at the input, in such a way as to detect any error conditions and then to generate, in accordance with these errors, the interruption request signal to the internal microcontroller 62 or to the main external microcontroller (not shown).

The main store 63 can store the program code containing the various instructions to be implemented in the internal microcontroller 62, and consists of a RAM unit (256×16) which interacts with the first counting unit 61 which stores the address relating to the instruction to be supplied at the output to the internal microcontroller 62.

As regards the secondary store 64, on the other hand, this can "interface" the internal microcontroller with the main external microcontroller, and has the function of storing a plurality of control parameters which characterize the operation of the electrical injector.

As mentioned above, each control unit 44 is connected to the synchronization bus 49*b* to receive from the latter a signal $S_{SINC}$ which encodes a set of data to enable the said control unit 44 to synchronize the commands to be sent to the operating circuit 11 with those sent by the other control units 44, according to a predetermined common command strategy for the electrical injectors.

As regards the synchronization unit 45, this is connected to the four state buses 49*a*, from which it receives the four corresponding state signals $S_{FLAG}$, and, in accordance with these, identifies the operating state of each control unit 44, so that it can coordinate and synchronize, on the basis of the detected states, the operating actions for the electrical injectors implemented by the said control units 44.

In particular, the synchronization unit 45 supplies at its output, on the basis of the four state signals $S_{FLAG}$, the synchronization signal $S_{SINC}$ on the synchronization bus 49*b*, by means of which the said signal $S_{SINC}$ is supplied to the inputs of the four control units 44.

The synchronization unit 45 is also connected by means of an I/O port (not shown) to the communication bus 49*c* by means of which it receives and/or transmits control signals to or from external control devices (not shown).

Figure 4:
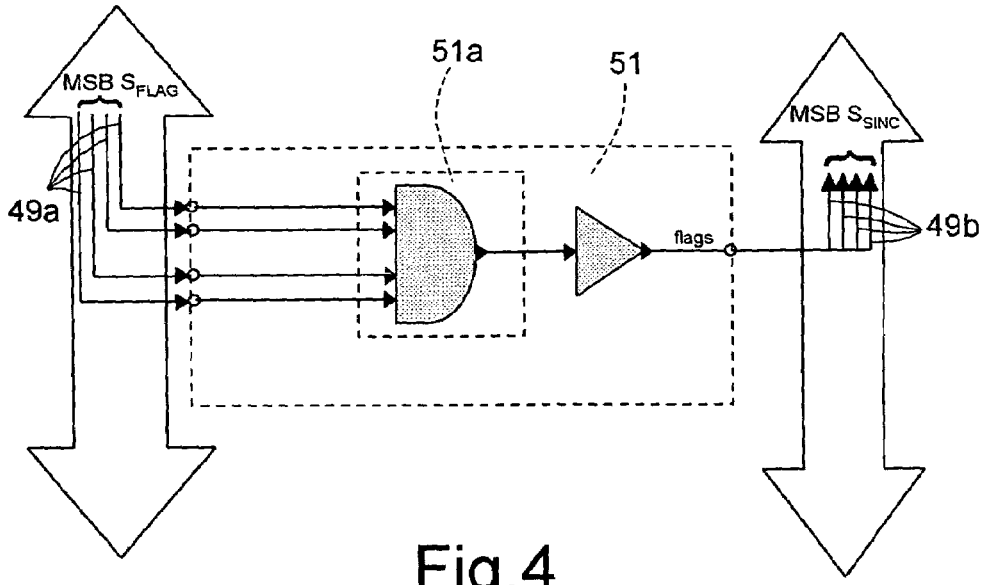
FIGS. 4 and 5 show in a schematic way the circuit architecture of a pair of synchronization stages included in a synchronization unit belonging to the operating device shown in FIG. 2.
Figure 5:
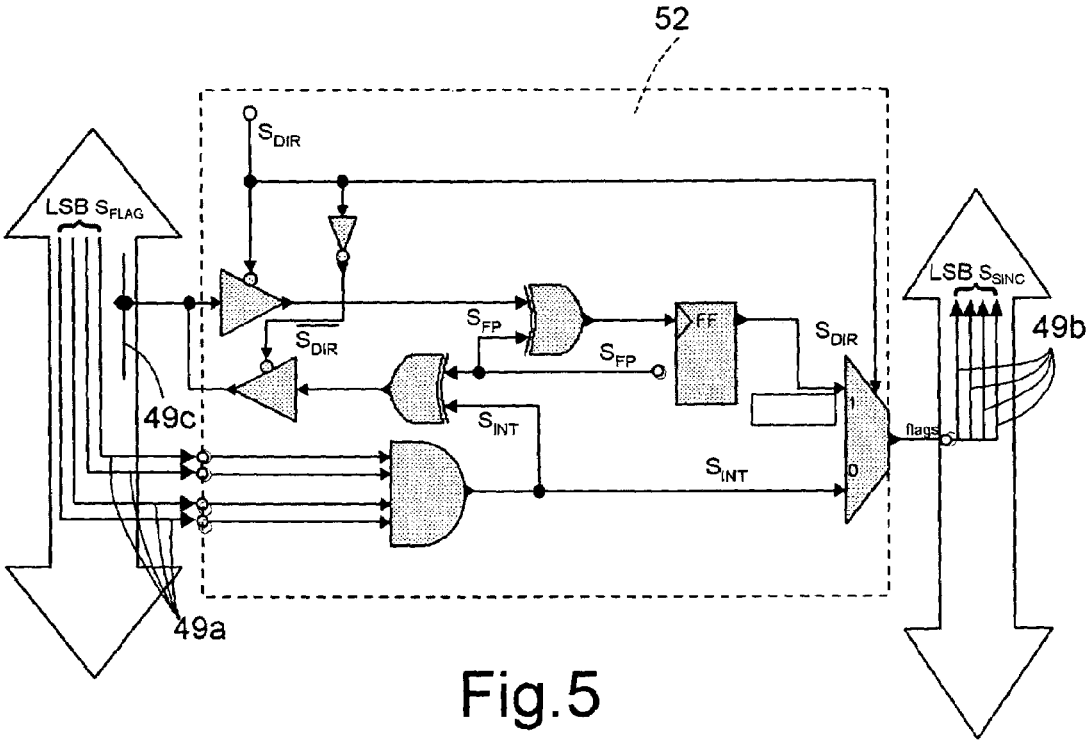

With reference to FIGS. 4 and 5 in particular, the synchronization unit 45 comprises two synchronization logic stages, which can implement a first set of logical operations on the most significant bits (flags) of the state signals $S_{FLAG}$, denoted below by the abbreviation MSB, and a second set of logical operations on the least significant bits (flags) of the state signals $S_{FLAG}$, denoted below by the abbreviation LSB.

In fact, each state signal $S_{FLAG}$ is encoded by the corresponding control unit 44 in N bits, where N is preferably equal to 16, in which the first $N_1$=12 bits of each state signal $S_{FLAG}$ are considered to be the MSBs and are supplied to the input of one of the two synchronization logic stages, referred to below as the synchronization logic stage 51 (FIG. 4), while the remaining $N_2$=4 bits of each state signal $S_{FLAG}$ are considered to be the LSBs and are supplied to the input of the other synchronization logic stage, referred to below as the synchronization logic stage 52 (FIG. 5).

As shown in the example of FIG. 4, the synchronization logic stage 51 comprises an AND circuit 51*a*, which is provided with four inputs connected to the corresponding four state buses 49*a* to receive the MSBs of the four corresponding state signals $S_{FLAG}$, and an output connected to the synchronization bus 49*b* on which it supplies the MSBs of the synchronization signal $S_{SINC}$.

In detail, the AND circuit 51*a* is provided with a set of AND logic gates (only one of which is shown schematically in FIG. 4), each of which can implement the AND operation between the corresponding MSBs contained in the four state signals $S_{FLAG}$.

In other words, each logic gate can execute the AND operation between the bits of the four state signals $S_{FLAG}$ which occupy the same coding position within the said signals. The synchronization logic stage 51 therefore supplies at its output, and transfers to the synchronization bus 49*b*, the 12 MSBs which make up the synchronization signal $S_{SINC}$, each of which is obtained by means of the AND operation executed between the four corresponding bits (flags) of the state signals $S_{FLAG}$.

With reference to FIG. 5, the input of the synchronization logic stage 52 is connected to the four state buses 49*a* to receive the LSBs of the four state signals $S_{FLAG}$, and its output is connected to the synchronization bus 49*b*, to which it supplies the 4 LSBs which, together with the 12 MSBs supplied at the output of the synchronization logic stage 51, make up the 16 bits which encode the signal $S_{SINC}$.

The synchronization logic stage 52 is also connected to the communication bus 49*c* to receive and/or transmit the control signals from or to the external devices and/or to the main external microcontroller (not shown), and can operate selectively, according to an command signal $S_{DIR}$, between a first and a second operating condition.

In fact, in the first operating condition, the synchronization logic stage 52 implements the logical AND between the corresponding LSBs of the four state signals $S_{FLAG}$ and supplies the 4 bits (flags) resulting from this operation both at its output, thus completing the synchronization signal $S_{SINC}$, and to the communication bus 49*c*, overwriting the LSBs of the control signal with the corresponding 4 bits of the control signal.

In the second operating condition, on the other hand, the synchronization logic stage 52 supplies directly on its output the 4 LSBs belonging to the control signal received on the communication bus 49*c*, thus overwriting the 4 LSBs of the synchronization signal $S_{SINC}$.

In particular, the synchronization logic stage 52 comprises four logical circuits which are identical with each other (only one of which is shown in FIG. 5), each of which can process the four LSBs occupying the same position in the corresponding four state signals $S_{FLAG}$.

As shown in the example of FIG. 5, each logic circuit of the synchronization logic stage 52 comprises an AND logic gate, a multiplexer, a pair of XOR (OR-exclusive) gates, two three-state gates, and a flip-flop.

In greater detail, the AND logic gate is provided with four inputs, each of which receives an LSB of a corresponding state signal $S_{FLAG}$ and is provided with an output supplying a signal $S_{INT}$ encoding the bit obtained from the AND operation among the, four incoming bits; a first XOR gate having a first input connected to the output of the AND gate to receive the signal $S_{INT}$, a second input for receiving a signal $S_{FP}$ for switching the polarities of the bits, and an output connected to the communication bus 49*c* by means of a first three-state gate which can be activated by the negated command signal $S_{DIR}$.

The second XOR gate, on the other hand, has an input connected to the communication bus 49*c* by means of the second three-state gate which can be activated by the command signal $S_{DIR}$, a second input receiving the signal $S_{FP}$ and an output connected to the input of the flip-flop.

Finally, as regards the multiplexer, this has a first input connected to the output of the flip-flop, a second input connected to the output of the AND gate, an output connected to the synchronization bus 49*b*, and, finally, a third input receiving the command signal $S_{DIR}$ which selectively activates the connection between the output and one of the two inputs.

In the first operating condition, the command signal $S_{DIR}$ activates the first three-state gate which connects the output of the first XOR gate to the communication bus 49*c*, the multiplexer is activated and supplies on its output the signal $S_{INT}$ available on the corresponding first input, while the negated command signal $S_{DIR}$ switches the second three-state gate to the high-impedance state.

In this case, therefore, the signal $S_{INT}$ resulting from the AND operation of the four LSBs of the four input signals is supplied, on the one hand, to the output of the multiplexer, forming one of the LSBs of the signal $S_{SINC}$, and, on the other hand, following the XOR logic operation (executed by the first XOR logic gate on the basis of the signal $S_{FP}$), to the communication bus 49*c*, in which one LSB of the control signal on the said communication bus 49*c* is overwritten.

In the second operating condition, on the other hand, the negated command signal $S_{DIR}$ activates the second three-state gate which connects the first input of the second XOR gate to the communication bus 49*c* and the multiplexer is activated, supplying at its output the signal supplied by the flip-flop.

The command signal $S_{DIR}$ switches the first three-state gate to the high impedance state, thus disabling the output of the first XOR gate and inhibiting the writing of the signal $S_{INT}$ to the communication bus 49*c*.

In this case, one of the 4 LSBs of the control signal present in the communication bus 49*c* is received at the input of the second XOR gate, which, following the logic operation, supplies it to the flip-flop, which in turn supplies it through the multiplexer to the synchronization bus 49*b*, thus causing the overwriting of a corresponding LSB of the signal $S_{SINC}$.

The synchronization unit 45 is provided not only with the two synchronization logic stages 51 and 52 described above., but also with a set of internal configuration registers, for example: a register containing the information on the polarity to be assigned to the flags according to which the signal $S_{FP}$ is generated; a register containing the information on the read/write "direction" or route to be assigned to the flags, according to which the command signal $S_{DIR}$ is generated; and a register containing the information on the control of the configuration of the bits or flags associated with the current thresholds in the measurement unit 47.

The synchronization unit 45 also comprises a first configuration unit (not shown), which can store the mode of access to the data stored in the internal stores of the control units 44 by external devices, such as the main external microcontroller (not shown).

Finally, the synchronization unit 45 comprises a malfunction control unit (not shown) for receiving interruption request signals (Interrupt) transmitted by the operating units 44 if a specified condition of malfunction of the electrical injectors is detected.

In fact, the malfunction control unit can receive from each control unit 44 a corresponding interruption request signal, and generates at its output, in accordance with these signals, a main interrupt signal, which is transmitted to the main external microcontroller, which identifies the control unit(s) 44 which have diagnosed the problem.

The operation of the operating device 41 can easily be deduced from the above description and requires no special explanation.

The operating device 41 for electrical actuators is highly advantageous in that it can coordinate the control actions implemented on the electrical injectors by the corresponding control units, thus providing a correct synchronization of the activation of the electrical injectors in the various stages of current maintenance and control.

Finally, the operating device described and illustrated herein can clearly be subjected to modifications and variations without entailing any departure from the scope of the present invention.

The invention claimed is:

1. Operating device (41) for inductive electrical actuators, comprising a power circuit (42) provided with an operating circuit (11) for each electrical actuator (12); the said operating circuit (11) comprising switch means (27, 28, 29) controlled selectively to regulate the current flowing through the said electrical actuator (12); the said operating device (41) additionally comprising a control circuit (43) for operating the power circuit (42), and being characterized in that it comprises:

a set of control modules (44), each of which selectively operates the said switch means (27, 28, 29) of a corresponding operating circuit (11), and supplies at its output a state signal ($S_{FLAG}$) indicating the operating state of the said control module (44); and synchronization means (45) for receiving and processing the state signals ($S_{FLAG}$), to generate a common synchronization signal ($S_{SINC}$) for synchronizing the said control modules (44) with each other; each said control module (44) being capable of synchronizing and coordinating, in accordance with the said synchronization signal $S_{SINC}$, the operating actions sent to the corresponding switch means (27, 28, 29) with the operating actions sent by the other control modules (44) to the corresponding switch means (27, 28, 29).

2. Operating device according to claim 1, characterized in that it comprises communication means (49) for communicating to the said synchronization means (45) the state signals ($S_{FLAG}$) supplied by the said control modules (44); the said communication means (49) being capable of communicating to each said control module (44) the synchronization signal ($S_{SINC}$) generated by the said synchronization means (45).

3. Operating device according to claim 2, characterized in that the said communication means (49) comprise a set of state buses (49*a*), each of which can communicate to the input of the said synchronization means (45) a corresponding state signal ($S_{FLAG}$) supplied by a corresponding control module (44), and at least one synchronization bus (44*b*) for communicating to the inputs of the said control modules (44*c*) the said synchronization signal ($S_{SINC}$) generated by the said synchronization means (45).

4. Operating device according to claim 1, characterized in that each state signal ($S_{FLAG}$) encodes a plurality of bits or flags associated with the operating state of the corresponding control module (44), and in that the said synchronization means (45) comprise logical operator means (51, 52) for generating the synchronization signal ($S_{SINC}$) implementing a first set of logical operations on a first set of bits or flags belonging to the said state signals ($S_{FLAG}$), and a second set of logical operations on the remaining bits or flags of the said state signal ($S_{FLAG}$).

5. Operating device according to claim 4, characterized in that the said logical operator means (51, 52) comprise a first AND logic circuit (51*a*), which is provided with a set of inputs connected to the said state buses (49*a*) to receive the most significant bits or flags of the corresponding state signals ($S_{FLAG}$), and at least one output connected to the said synchronization bus (49*b*) to supply the most significant bits or flags of the said synchronization signal ($S_{SINC}$); each of the said most significant bits or flags of the said synchronization signal ($S_{SINC}$) being generated at the output of the first AND logic circuit implementing the AND logic operation on the said most significant bits or flags of the corresponding state signals ($S_{FLAG}$).

6. Operating device according to claim 5, characterized in that the said logical operator means (51, 52) comprise a second AND logic circuit (52*a*), which is provided with a set of inputs connected to the said state buses (49*a*) to receive the least significant bits or flags of the corresponding state signals ($S_{FLAG}$), and at least one output connected to the said synchronization bus (49*b*), on which it supplies the least significant bits or flags of the said synchronization signal ($S_{SINC}$), and a communication gate connectable to a communication bus (49*c*) for receiving and/or transmitting a control signal from or to external control means.

7. Operating device according to claim 6, characterized in that the said second AND logic circuit (52*a*) can, on command, operate between a first operating condition in which it generates the least significant bits or flags of the synchronization signal ($S_{SINC}$) according to the least significant bits or flags of the said state signals ($S_{FLAG}$), and a second operating condition in which it generates the least significant bits or flags of the synchronization signal ($S_{SINC}$) in accordance with the bits or flags of the control signal received on the said communication bus (49*c*).

8. Operating device according to claim 7, characterized in that the said second AND logic circuit (52*a*), in the first operating condition, can implement an AND logic operation on the said least significant bits or flags of the said state signals ($S_{FLAG}$).

9. Operating device according to claim 8, characterized in that the said second AND logic circuit (52*a*) in the said first operating condition can modify the said control signal on the said communication bus (49*c*) in accordance with the said least significant bits or flags of the said state signals ($S_{FLAG}$).

10. Operating device according to claim 6, characterized in that the said control circuit (43) comprises communication means (48) for controlling the communication of the information between the said control circuit (43) and external control means.

11. Operating device according to claim 1, characterized in that the said control circuit (43) comprises measurement means (47) for measuring, for each of the said electrical actuators (12), the current flowing through the said electrical actuator (12), and for supplying a signal ($S_{SENSE}$) encoding the said measured current.

12. Operating device according to claim 1, in which the said power circuit (42) comprises at least one booster device and the said switch means (27, 28, 29) comprise at least a first transistor (27) which can be activated selectively to connect the said booster device to the said operating circuits (11) present in the said power circuit (42); the said control circuit (43) comprising booster operating means (46) for controlling the said first transistor (27) in such a way as to control the activation of the said booster device.

13. Operating device according to claim 3, in which the said switch means (27, 28, 29) of each said operating circuit (11) comprise a second and third transistor (28, 29) which can be activated selectively to regulate the current flowing in the corresponding electrical actuator (12); the said operating device (41) being characterized in that each said control module (44) is connected, on the one hand, to the said communication bus (49*c*), to the said state bus (49*a*), and to the said synchronization bus (49*b*), and, on the other hand, to the corresponding control circuit (11) to which it supplies a first and a second control signal (hs_cmd, ls_cmd) to control, respectively, the second and third transistors (28, 29) of the said control circuit (11).

14. Operating device according to claim 1, characterized in that the said control circuit (43) consists of an integrated circuit card of the ASIC type.

* * * * *